US006716150B2

(12) United States Patent
Purcell

(10) Patent No.: US 6,716,150 B2
(45) Date of Patent: Apr. 6, 2004

(54) EASY OPEN ENVELOPE

(75) Inventor: Douglas K. Purcell, Chicopee, MA (US)

(73) Assignee: Mead Westvaco Corp, Stamford, CT (US)

( * ) Notice: Subject to any disclaimer, the term of this patent is extended or adjusted under 35 U.S.C. 154(b) by 0 days.

(21) Appl. No.: 10/256,583

(22) Filed: Sep. 27, 2002

(65) Prior Publication Data

US 2003/0015581 A1 Jan. 23, 2003

Related U.S. Application Data

(62) Division of application No. 09/804,798, filed on Mar. 14, 2001, now Pat. No. 6,491,213.

(51) Int. Cl.[7] ..... B31B 1/14; B31B 1/62

(52) U.S. Cl. ..... 493/917; 493/923; 493/931

(58) Field of Search ..... 493/917, 923, 493/931

(56) References Cited

U.S. PATENT DOCUMENTS

| | | | | | |
|---|---|---|---|---|---|
| 3,298,598 | A | * | 1/1967 | Eberstadt | 229/312 |
| 3,380,648 | A | * | 4/1968 | De Lyra | 229/71 |
| 3,392,908 | A | * | 7/1968 | Shelley et al. | 229/309 |
| 3,501,086 | A | * | 3/1970 | Kuniyukii | 229/313 |
| 4,781,296 | A | * | 11/1988 | Morris et al. | 383/205 |
| 5,290,225 | A | * | 3/1994 | Younger | 493/188 |
| 5,697,879 | A | * | 12/1997 | Nokelainen | 493/264 |
| 6,248,049 | B1 | * | 6/2001 | Scheggetman | 493/188 |
| 6,457,638 | B1 | * | 10/2002 | Schmidt | 229/310 |
| 6,491,213 | B2 | * | 12/2002 | Purcell | 229/309 |

* cited by examiner

*Primary Examiner*—Rinaldi I. Rada
*Assistant Examiner*—Gloria Weeks
(74) *Attorney, Agent, or Firm*—D. L. Bowman

(57) ABSTRACT

An envelope comprising a tear strip that functions as an efficient opening means for access to the envelope contents.

15 Claims, 2 Drawing Sheets

EASY OPEN ENVELOPE

This is a divisional application of U.S. application Ser. No. 09/804,798 filed on Mar. 14, 2001. U.S. Pat. No. 6,491,213 issued on Dec. 10, 2002.

TECHNICAL BACKGROUND AND FIELD OF APPLICABILITY OF THE INVENTION

The invention is directed to an envelope and method of making the envelope. A tape strip is located along the perimeter of the front panel and a portion of the seal flap on the interior of the envelope.

BACKGROUND OF THE INVENTION

The stationery envelope has been an indispensable tool for communication throughout the last century, and, accordingly, much effort has been focused on making the design, manufacture and user-friendliness of this instrument more efficient and economical. In particular, several attempts have been made to improve the technical design of the envelope to allow the user easier access to the envelope contents, while at the same time reducing the risk of accidentally tearing the envelope body and damaging its contents or causing injury to the user.

The use of tear guides has been one means of providing simple, controlled access to the envelope contents. For example, U.S. Pat. No. 2,161,958 (MacDonald) discloses an envelope in which a cutting element is secured to the inner face of the rear section of the envelope. The cutting element, which may be a thin, twisted ribbon of cellophane, is secured between the upper and lower edges of the inner rear face of the envelope. In this position, according to the patent, the cutting element is in a concealed and inaccessible position within the envelope. Arced perforations near one or both corners of the rear section expose one or both ends of the cutting element at the back of the envelope, allowing the exposed ends to be grasped and pulled outward with a slitting motion to open the envelope.

U.S. Pat. No. 2,956,727 (Chevan) describes an envelope that includes a side strip secured to the inside of the front panel near the fold between the front and rear sections of the envelope. The portion of the strip that is between the front and rear sections has a pressure sensitive adhesive applied on either side, which permits the strip to function as a tearing member. The strip also allows functions as a re-sealing member that can be inserted between the open edges of the envelope to close it after it has been opened. An exposed portion of the strip containing no adhesive extends beyond the upper edge of the front panel, and when the envelope is sealed, this exposed portion is partially positioned beneath the upper sealing flap to provide an end or tab that can be lifted by the user and pulled to remove the strip and open the envelope.

U.S. Pat. No. 3,392,908 (Shelley) discloses a paper stationery envelope with a combination of corner guides and an internal tear strip of paper, plastic or cloth placed on the interior surface of the envelope along substantially the entire length of one or more edge folds of the envelope. The strip placed along the edge fold extends either over the entire length of the edge fold or close to the end of each edge, but, in any event, does not extend beyond the edges and there is no external indication of its presence.

This prior art, while recognizing the need for an envelope that can be torn open without detriment to the contents, has not solved the problem of providing an envelope with a reliable tear mechanism that can readily be identified by the user, and which is easy to manufacture on-line in a machine process for making envelopes.

SUMMARY OF THE INVENTION

The invention teaches an envelope with a tape strip secured to the front panel of the envelope on the inside of the envelope. The tape strip extends to the perimeter of the seal flap. A perforated region is formed on the seal flap adjacent to the tape strip. The envelope is opened by pulling the tear seal flap in the vicinity of the perforated region. The tape strip controls the movement of the tear and allows the envelope to be opened without damaging the contents of the envelope.

DETAILED DESCRIPTION OF THE PREFERRED EMBODIMENTS OF THE INVENTION

Figure 1:
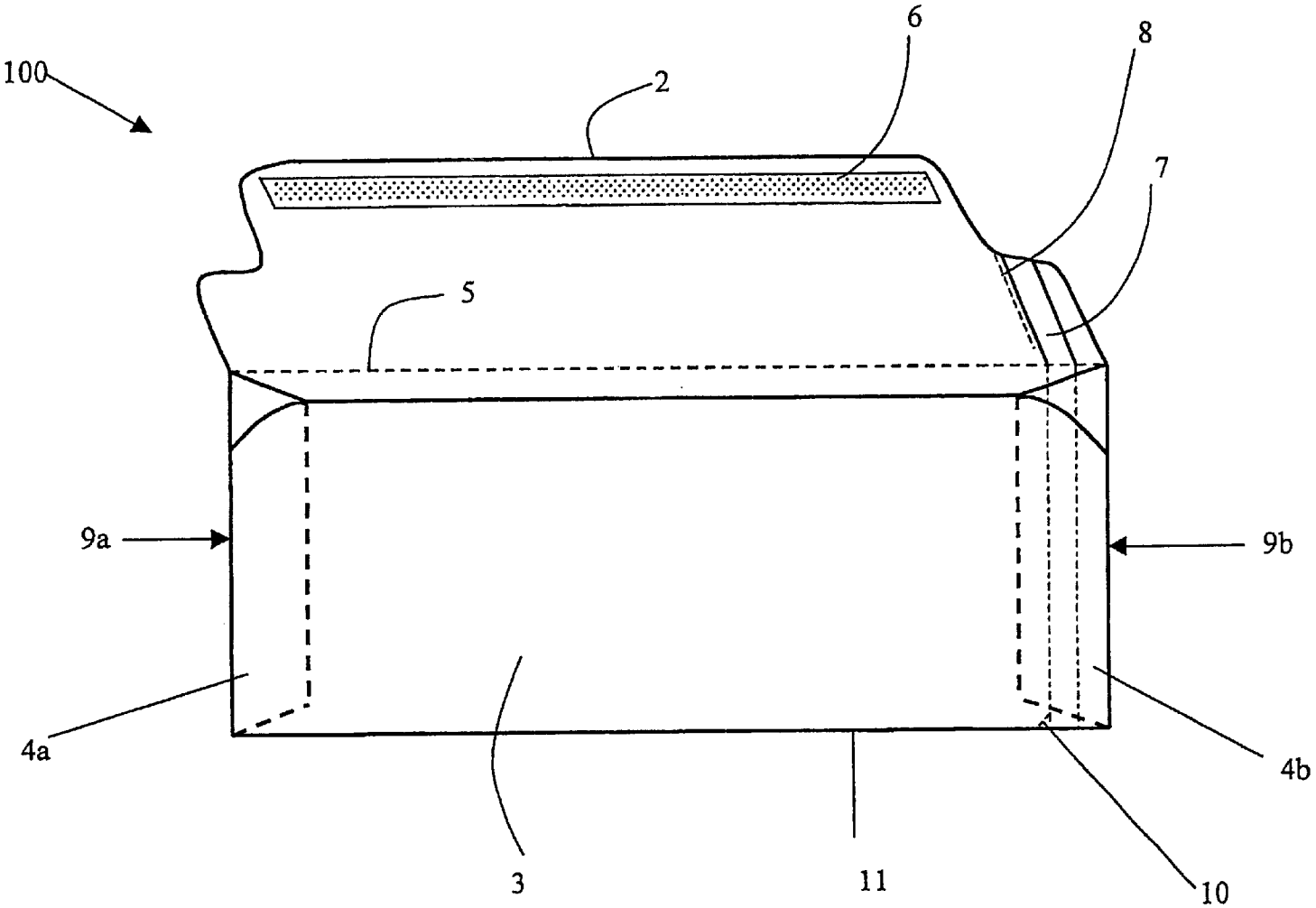
FIG. 1 is an isometric drawing of a preferred embodiment of the invention.

FIG. 1 represents one preferred embodiment of the present invention, in which the envelope 100 comprises a front panel 1, a seal flap 2 which is a vertical extension of the front panel 1, and which is separated from said front panel by a fold line 5; a rear panel 3 and side flaps 4*a* and 4*b*. Side flaps 4*a* and 4*b* are lateral extensions of the front panel 1, which are foldably connected to said front panel 1 via fold lines 9*a* and 9*b*. When the envelope is formed, side flaps 4*a* and 4*b* are folded under and attached to the interior of the rear panel 3. Seal flap 2, which is foldably connected via fold line 5 to the front panel 1, further includes an adhesive seal zone 6, which is coated with a gummy adhesive suitable for sealing the envelope 100. The gummy adhesive can be a self-sealing polymeric material, which may optionally be covered by a protective strip until it is desired that the envelope be sealed. Alternatively, the gummy adhesive may be of a type that requires moistening in order to form an effective seal. The tape strip 7, which forms the opening element of the envelope 100, is attached along the entire length of the front panel 1 close to the fold line 9*b* between front panel 1 and side panel 4*b*. In a preferred embodiment, the tape strip 7 is a strength-bearing plastic material, such as is used in packaging tape. The material employed as the tape strip in various embodiments of the invention is, however, dependent on the type of substrate used to make the body of the envelope. In this respect, the relative strength and tear resistance of the tape strip should be greater than that of the envelope substrate, to enable tearing and removal of the tape strip from the envelope body without tearing the tape strip itself.

The tape strip 7 extends across the length of the seal flap 2, and co-terminates with the edge of seal flap 2. Because the upper edge of the tape strip 7 and the upper edge of the seal flap 2 are aligned in this manner, the envelope blank can be passed through a forming machine without accidental snagging or tearing away of the tape strip 7. In addition, the formed envelope can also be sealed in a machine in the absence of similar undesirable results. Consequently, the present invention provides an efficient and therefore cost-effective product and means for mass-mailing campaigns and other applications where speed, efficiency and high volume throughput are desired. A perforation 8, which serves as a tear initiation guide, is provided near the upper edge of the tape strip 7. A second perforation 10 is also provided near the lower edge of tape strip 7 to provide a similar function. Preferably, as shown in the figures, the lower perforation 10 is positioned at an angle to the tape strip 7 to prevent the tear line from moving in the direction of the envelope body as the tear strip 7 is torn away.

Figure 2:
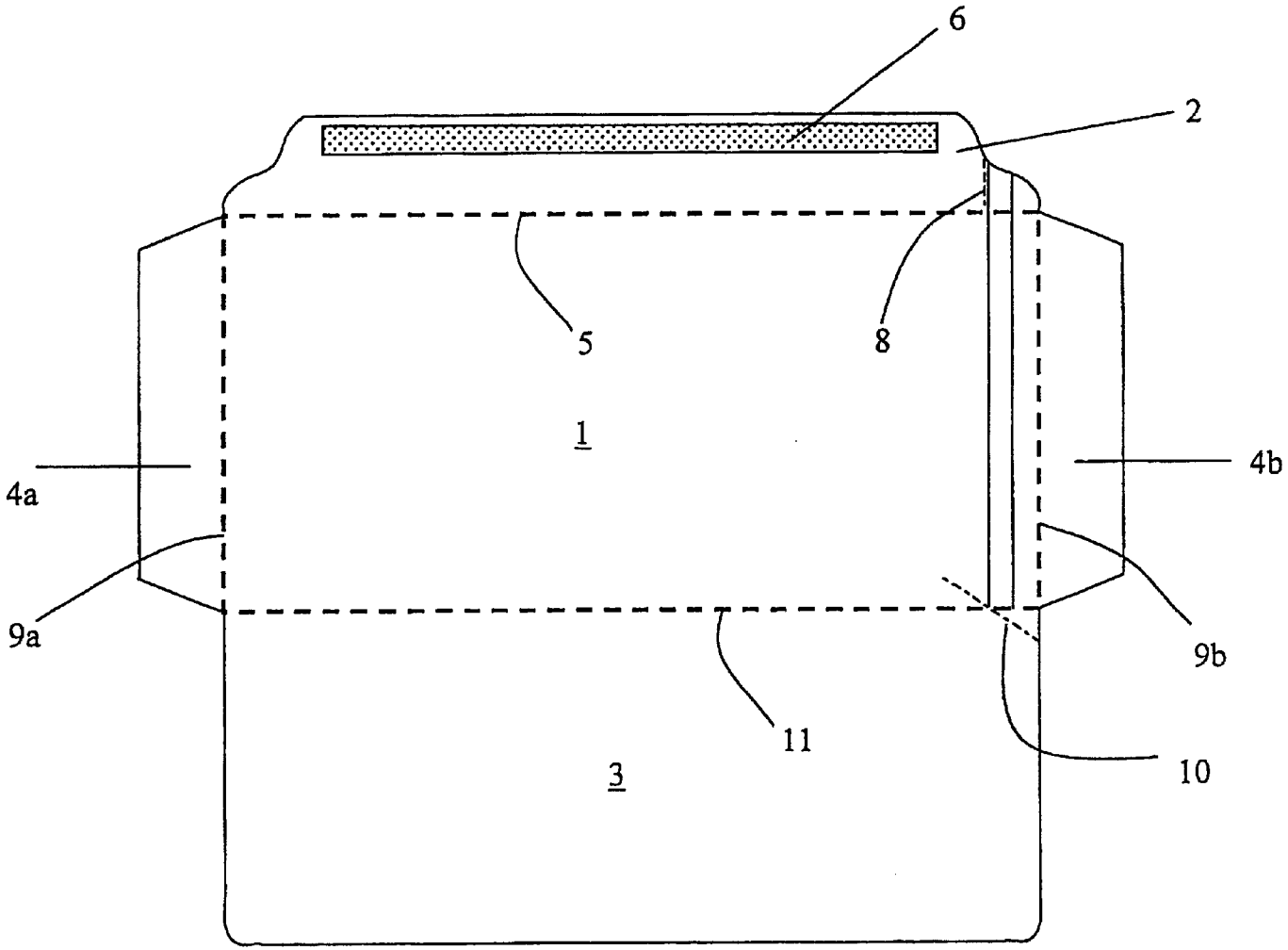
FIG. 2 is a plan drawing of a blank for forming an envelope according to the practice of the invention.

FIG. 2 is representative of a blank for forming an envelope according to one embodiment of the invention. The blank is formed by cutting a paper substrate to fit the desired dimensions. While the typical stationery envelope is formed from a bleached or unbleached paper grade in a weight range of from about sub 20 to about sub 24 (about 50 lb./ream to about 60 lb./ream, ream size 3300 ft.$^2$), it is to be understood that the invention may be applied to paper and paperboard substrates in a wide range of thickness, basis weight, density, texture and finish. The blank may be cut to provide a notched or angled seal flap, which enables formation of a seal zone 6 that is offset in relation to the side folds 9*a* and 9*b* and the tape strip 7. Fold line 5 delineates the front panel 1 from the seal flap 2, and fold lines 9*a* and 9*b* separate the laterally extended side flaps 4*a* and 4*b* from front panel 1. Rear panel 3 is separated from the front panel 1 by fold line 11.

It is believed that the present invention includes many other embodiments that may not be herein described in detail, but would nonetheless be appreciated by those skilled in the art from the disclosures made. Accordingly, this disclosure should not be read as being limited only to the foregoing examples or only to the designated preferred embodiments.

I claim:

1. A method of making an envelope comprising the steps of:

providing a substrate;

forming an envelope blank from said substrate, wherein said envelope blank comprises a front panel, a rear panel secured to said front panel, a seal flap secured to said front panel, wherein said seal flaps has at least two side edges and an upper free edge, and two side flaps secured to said front panel;

securing a tape strip to said front panel from about the boundary between said front panel and said rear panel and extending along the perimeter of said front panel to about the upper free edge of said seal flap at least some distance from the boundary between said front panel and said seal flap;

forming a first perforated region from the perimeter of said seal flap parallel and adjacent to said tape strip and extending at least some distance along said seal flap;

folding said two side flaps;

securing an adhesive to at least some portion of said two side flaps and to at least some perimeter portion of said seal flap; and folding said rear panel and securing said rear panel to said two side flaps.

2. The method of claim 1 wherein the tape strip is secured to said envelope blank by an adhesive means.

3. The method of claim 2 wherein said adhesive means on said tape strip comprises a self-contained adhesive on one side of the tape strip.

4. The method of claim 3 wherein a protective strip is secured to the adhesive side of said tape strip.

5. The method of claim 4 wherein said protective strip is removed prior to folding said envelope blank.

6. The method of claim 5 wherein a second perforated region is formed on said envelope blank from the perimeter of said rear panel nearest to said tear strip at about the boundary between said rear panel and said front panel and extending to said front panel to a region just past the perimeter of said tape strip farthest from the perimeter of said front panel.

7. The method of claim 6 wherein said second perforated region is at an angle to said tape strip.

8. The method of claim 4 wherein the envelope is formed in an envelope forming machine.

9. The method of claim 1 wherein said tape strip extends from the boundary between said front panel and said seal flap to the perimeter of said upper edge of said seal flap.

10. The method of claim 1 wherein said first perforated region is located on the side of said tape strip farthest from the perimeter of said front panel.

11. The method of claim 1 wherein said envelope blank is formed from a single substrate.

12. The method of claim 1 wherein said front panel, rear panel, seal flap, and two side flaps are secured to each other by fold lines.

13. The method of claim 1 wherein said tape strip is formed from a material comprising plastic.

14. The method of claim 1 wherein said first perforated region is shaped to form a tear initiation guide.

15. The method of claim 1 wherein the tear strength of said tape strip is greater than the tear strength of said envelope blank.

* * * * *